US006808070B2

(12) United States Patent
Borg

(10) Patent No.: US 6,808,070 B2
(45) Date of Patent: Oct. 26, 2004

(54) TANDEM HARNESS FOR TUB-LIKE CONTAINERS

(75) Inventor: Zakary J. Borg, Eugene, OR (US)

(73) Assignee: Oregon Precision Industries, Inc., Eugene, OR (US)

( * ) Notice: Subject to any disclaimer, the term of this patent is extended or adjusted under 35 U.S.C. 154(b) by 149 days.

(21) Appl. No.: 10/337,554

(22) Filed: Jan. 6, 2003

(65) Prior Publication Data

US 2004/0129593 A1 Jul. 8, 2004

(51) Int. Cl.[7] ..... B65D 65/00; B65D 75/00; A47G 19/00; B66C 1/10

(52) U.S. Cl. ..... 206/427; 206/150; 206/151; 220/23.4; 294/87.2

(58) Field of Search ..... 206/428, 427, 206/145, 147, 148, 150, 151, 158, 159, 160; 220/23.83, 23.4; 294/27.1, 87.2, 166, 151, 159, 87.28, 87.1, 87.11, 87.12, 87.22, 87.24, 87.26

(56) References Cited

U.S. PATENT DOCUMENTS 4,331,357 A * 5/1982 Contreras ..... 294/145
4,360,231 A * 11/1982 Bolin ..... 294/87.2
4,372,598 A * 2/1983 Quelch ..... 294/87.2
4,634,002 A * 1/1987 Delonghi ..... 206/158
4,823,959 A * 4/1989 Bixler ..... 206/562
4,925,020 A * 5/1990 Gordon ..... 206/150
5,096,246 A * 3/1992 Cnare ..... 294/87.2
5,139,137 A * 8/1992 Marco ..... 206/150
5,188,413 A * 2/1993 Nathan ..... 294/87.2
5,306,060 A 4/1994 Borg
6,394,517 B1 5/2002 Borg
6,715,810 B2 * 4/2004 Borg ..... 294/87.2

FOREIGN PATENT DOCUMENTS

EP 000436107 A2 * 7/1991

* cited by examiner

*Primary Examiner*—Derris H. Banks
*Assistant Examiner*—Faye Francis
(74) *Attorney, Agent, or Firm*—Chernoff, Vilhauer, McClung & Stenzel, LLP

(57) ABSTRACT

A harness for holding two tub-like containers together is disclosed.

9 Claims, 2 Drawing Sheets

TANDEM HARNESS FOR TUB-LIKE CONTAINERS

BACKGROUND OF THE INVENTION

The use of carrier straps for bottles or jugs is known. See, for example, U.S. Pat. Nos. 5,306,060 and 6,394,517. Similarly, the use of resilient webs for harnessing together six-packs of beverages and tub-like containers is known. The use of shrink-wrap or paper trays to band together multiple tub-type containers is also known. However, all such devices have inherent drawbacks with respect to holding tub containers together in that the tub containers are difficult to extract from them and often loosen during shipment or with changes in temperature.

There is therefore a need in the container industry for a device capable of harnessing containers together that is simple to apply to and remove from the tub-type container, that will not loosen during shipment or with temperature changes, and that is inexpensive to manufacture.

These needs and other which will become apparent to one of ordinary skill upon consideration of the specification herein are met by the present invention.

BRIEF SUMMARY OF THE INVENTION

According to the present invention there is provided a tandem harness for two tub-like containers, comprising two discontinuous circular resilient bands joined by an intermediate web, each of the bands having at least two discontinuities, and each of the discontinuities having an offset catch assembly integral with the bands, wherein each catch assembly comprises (i) two legs joining the bands at approximately right angles, (ii) an inverted U-shaped member attached to the two legs, and (iii) a catch for engaging the upper periphery of the containers.

DETAILED DESCRIPTION OF THE PREFERRED EMBODIMENT

Figure 1:
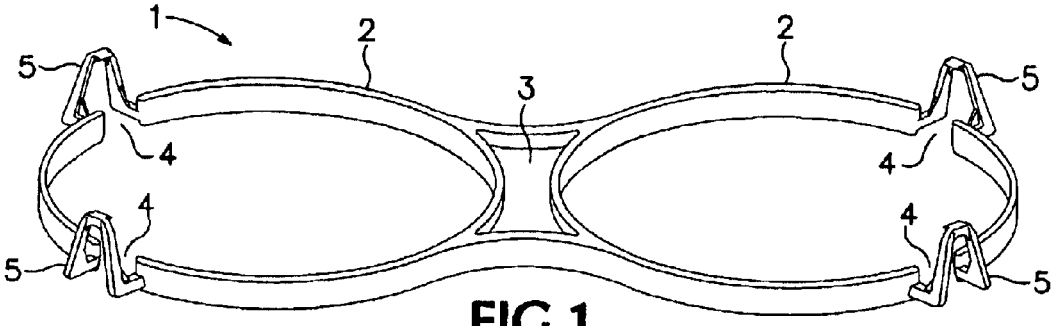
FIG. 1 is a perspective view of an exemplary embodiment of the tub harness of the invention.
Figure 2:
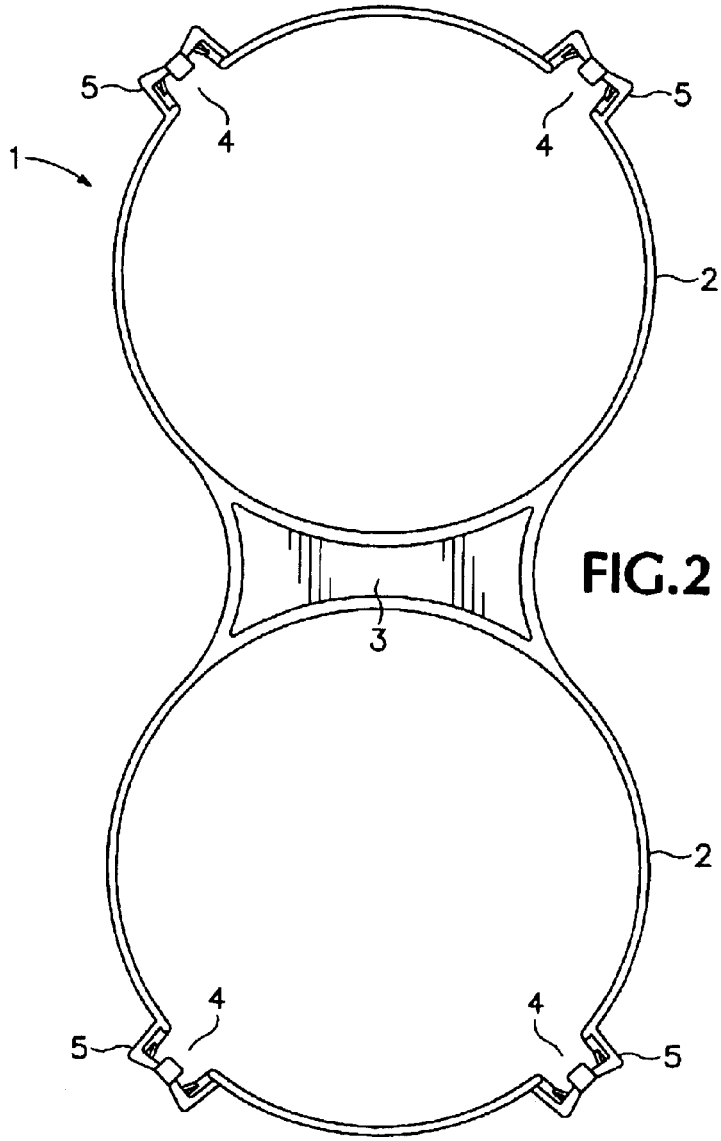
FIG. 2 is a plan view of the tub harness shown in FIG. 1.
Figure 3:
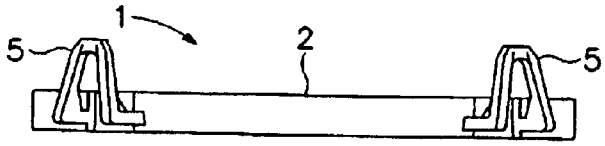
FIG. 3 is an end view of the tub harness shown in FIG. 1.
Figure 5:
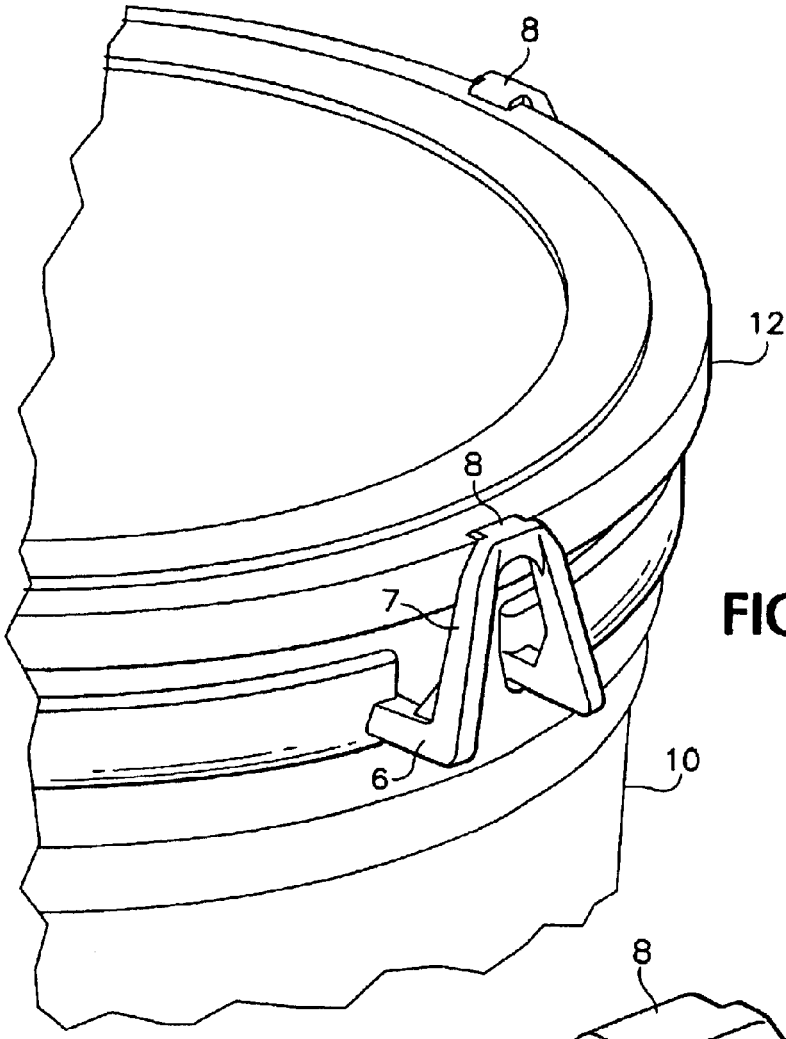
FIG. 5 is a perspective view of one lobe of the tub harness of FIG. 1 in engagement with a tub having a lid.
Figure 4:
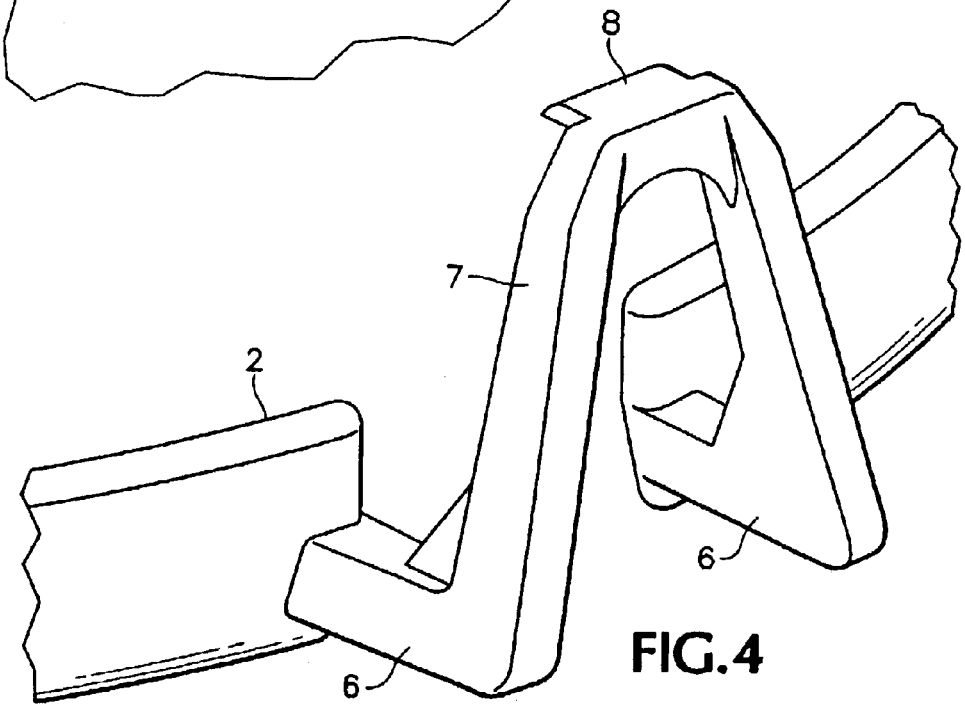
FIG. 4 is a close-up perspective view of the catch assembly of the tub harness shown in FIG. 1.

Referring to the drawings, where the same numerals refer to like elements, there are shown in FIGS. 1–4 a tandem harness 1 for two tub-like containers typically found in the food industry. The harness comprises two generally circular bands 2 preferably formed from a polymer such as a polyolefin, e.g., high density polyethylene, the polymer imparting a degree of resiliency. The two bands are joined by a web 3, and have at least two discontinuities 4. Each discontinuity is provided with an offset catch assembly 5 that is integral with the bands 2, and which comprises two legs 6 joining the bands at approximately right angles, an inverted U-shaped member 7 attached to legs 6, and a catch 8 for engaging the upper peripheral rim of the tubs. In a preferred embodiment depicted in FIG. 5, tub 10 has a lid 12, which is engaged along its periphery by an upper portion of inverted U-shaped member 7 and on its surface by catch 8. Preferably inverted U-shaped member 7 is oriented at about 90° relative to legs 6, and is tapered slightly toward catch 8. Catch 8 is also preferably oriented at about 90° relative to inverted U-shaped member 7.

To install the tandem harness on a pair of tub containers with lids, one of the bands 2 is slipped over the bottom of the tub container 10 and raised until the band is just below the lid 12, followed by slightly splaying catch assemblies 5 outwardly until catches 8 engage the top of lid 12 by virtue of their design and the resiliency of the material from which the entire harness is made, then releasing them. The procedure is repeated with the second band over a second tub, thereby securing the two tubs together. To release the harness, the catch assembly 5 is again simply splayed slightly outwardly to disengage catch 8 from the lids, and the band 2 is slipped downwardly off the tub.

When tub containers are secured together by the harness, they are more stable in shipping boxes, on the store shelf or in a grocery bag. The harnesses of the invention have such a low profile above the tub lid that stacking of the tub containers two-by-two is readily accomplished. In addition, the design readily permits stacking of the harnesses themselves, thereby facilitating automated manufacture of them and easing handling and shipping in large quantities.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed:

1. A tandem harness for two tub-shaped containers, comprising two discontinuous circular resilient bands joined by an intermediate web, each of said bands having at least two discontinuities, and each of said discontinuities having an offset catch assembly integral with said bands, wherein each catch assembly comprises (i) two legs joining said bands at approximately right angles, (ii) an inverted U-shaped member attached to said two legs, and (iii) a catch for engaging the upper periphery of said containers.

2. The harness of claim 1 wherein said containers have lids and said catch engages said lids.

3. The harness of claim 2 wherein said inverted U-shaped member is oriented at about 90° relative to said two legs.

4. The harness of claim 3 wherein said inverted U-shaped member is tapered.

5. The harness of claim 4 wherein said catch is oriented at about 90° relative to said inverted U-shaped member.

6. The harness of claim 5 wherein said catch is adapted to snugly engage said lids.

7. The harness of claim 6 wherein said catch is adapted to snugly engage the top surface of said lids.

8. The harness of any of claims 1–7 made from a polymer.

9. The harness of claim 8 wherein said polymer is high density polyethylene.

* * * * *